US009409226B2

(12) United States Patent
Koppensteiner

(10) Patent No.: US 9,409,226 B2
(45) Date of Patent: Aug. 9, 2016

(54) APPARATUS FOR FORGING A HOLLOW BODY

(75) Inventor: Robert Koppensteiner, Steyr (AT)

(73) Assignee: GFM-GmbH, Steyr (AT)

( * ) Notice: Subject to any disclaimer, the term of this patent is extended or adjusted under 35 U.S.C. 154(b) by 196 days.

(21) Appl. No.: 13/548,556

(22) Filed: Jul. 13, 2012

(65) Prior Publication Data

US 2013/0036785 A1 Feb. 14, 2013

(30) Foreign Application Priority Data

Aug. 12, 2011 (AT) ..... A 1171/2011

(51) Int. Cl.
*B21J 7/14* (2006.01)
*B21J 13/00* (2006.01)

(52) U.S. Cl.
CPC ... *B21J 7/14* (2013.01); *B21J 13/00* (2013.01)

(58) Field of Classification Search
CPC ..... B21C 25/04; B21C 25/08; B21C 3/16; B21J 7/14–7/16; B21D 37/04
USPC ..... 72/95–97, 209, 264, 370.01, 370.04, 72/398, 76; 269/48.1
See application file for complete search history.

(56) References Cited

U.S. PATENT DOCUMENTS 1,638,633 A * 8/1927 Hinman ..... B21D 22/025 72/478
1,654,536 A * 1/1928 Cotton ..... A41D 1/06 72/478
1,683,573 A * 9/1928 Mueller ..... B21D 9/03 72/478
4,131,988 A * 1/1979 Finegold ..... 72/142
4,641,776 A * 2/1987 Vlasek et al. ..... 72/393
5,500,995 A * 3/1996 Palmieri ..... H05H 7/20 72/478
6,244,092 B1 * 6/2001 Grobbenhaar ..... B21D 9/03 72/466
7,128,146 B2 * 10/2006 Baugh ..... E21B 43/105 72/393
8,166,792 B2 * 5/2012 Prasser et al. ..... 72/96
2007/0186604 A1 * 8/2007 Koppensteiner ..... 72/97
2010/0075074 A1 * 3/2010 Wilson et al. ..... 156/189
2010/0251794 A1 * 10/2010 Wiedenmaier et al. ..... 72/264
2010/0263423 A1 * 10/2010 Baumer et al. ..... 72/371

FOREIGN PATENT DOCUMENTS

AT 350 356 5/1979
DE 27 54 443 A1 6/1979
EP 116 A1 * 1/1979
GB 2 003 411 3/1979
JP 63 309347 A 12/1988

OTHER PUBLICATIONS

European Search Report in EP 12 17 3396, dated Dec. 4, 2012.

* cited by examiner

*Primary Examiner* — Shelley Self
*Assistant Examiner* — Pradeep C Battula
(74) *Attorney, Agent, or Firm* — Collard & Roe, P.C.

(57) ABSTRACT

An apparatus for forging a hollow body has forging tools which are arranged in a centrically symmetrical way about a forging axis, and a forging mandrel. The forging mandrel has a mandrel core and mandrel segments which are distributed over the circumference of the mandrel core, are exchangeably held on the mandrel core, and form forming surfaces for the hollow space of the hollow body.

8 Claims, 5 Drawing Sheets

APPARATUS FOR FORGING A HOLLOW BODY

CROSS REFERENCE TO RELATED APPLICATIONS

Applicant claims priority under 35 U.S.C. §119 of Austrian Application No. A 1171/2011 filed on Aug. 12, 2011, the disclosure of which is incorporated by reference.

The invention relates to an apparatus for forging a hollow body with forging tools which are arranged in a centrically symmetrical way about the forging axis, and with a forging mandrel.

The forging of hollow bodies, especially tubes, offers the advantage among other things over known rolling methods for producing such hollow bodies that different external forms of the hollow body can be produced due to the comparatively simple exchange of the forging tools and the general possibility of tool adjustment. This does not apply to the forging mandrels which determine the internal form of the hollow body, which mandrels are made of a heat-resistant material and need to have an outside diameter corresponding to the respective inside diameter of the hollow body, so that separate forging mandrels need to be used for different internal contours of the hollow bodies to be produced.

In order to increase the service life of thermally loaded forging mandrels, it is known (AT 350 356 B) to provide for the forging mandrel an external jacket made of a heat-resistant steel on a support sleeve which is cooled, so that the service life of the forging mandrel can be increased as a result of the different materials in connection with cooling of the support sleeve with a water-air mixture. Such a configuration of a forging mandrel does not provide any advantages concerning the adjustment to different internal contours of the hollow bodies to be produced.

The invention is therefore based on the object of reducing the effort, especially concerning the warehousing of the forging mandrels, in connection with the retooling of forging apparatuses for producing hollow bodies with different hollow space dimensions.

On the basis of a forging apparatus of the kind mentioned above, this object is achieved by the invention such a way that the forging mandrel comprises a mandrel core and mandrel segments which are distributed over the circumference of the mandrel core, are exchangeably held on the mandrel core, and form forming surfaces for the hollow space of the hollow body.

Since a uniform mandrel core can be used as a result of this measure for different diameters of the hollow space of the hollow bodies to be produced, while mandrel segments which are relevant for the formation of the internal contour of the hollow body and which are exchangeably in held on the mandrel core are associated with forming surfaces, the possibility is provided to use mandrel segments adjusted to the respective inside diameters of the hollow bodies to be produced without having to replace the mandrel core. These exchangeable mandrel segments which are distributed over the circumference of the mandrel core not only allow a simple adjustment of the forging mandrel to different dimensions of the hollow body, but also offer better possibilities for utilizing the materials because the heat-resistant materials merely need to be used in the region of the mandrel segments.

Furthermore, the mandrel segments can be arranged in a thermally insulated manner in relation to the mandrel core, so that the mandrel core can be protected substantially from higher thermal loads. Moreover, advantageous conditions for potential cooling or heating of the mandrel segments are obtained, which can be connected to respective cooling or heating devices via lines provided in the mandrel core for a cooling or heating medium.

The mounting of the mandrel segments on the mandrel core can be achieved in different ways from a constructional point of view. A simple procedure to exchange the mandrel segments without any special effort is to insert the mandrel segments in undercut grooves of the mandrel core in an interlocking fashion. It is principally possible to arrange the undercut grooves parallel or transversely to the mandrel axis, so that the mandrel segments are grasped once along their longitudinal edges and the other time on their face side.

The undercut grooves can be incorporated in the mandrel core. Especially simple constructional conditions are obtained however when at least one sidewall of the undercut grooves is arranged as a profile strip which is detachably connected with the mandrel core, because in this case the associated mandrel segments can be removed transversely to the longitudinal direction of the undercut groove from the mandrel core by detaching said profile strip.

In order to achieve different diameters for the hollow body, mandrel segments with different radial extensions can be used. In order to ensure that the required number of different mandrel segments can be kept at a low level, the mandrel segments can be supported on the mandrel core by way of spacers. The diameter of the envelope circles of the mandrel segments can be adjusted to the internal dimensions of the hollow body to be produced by adjustable or exchangeable spacers, without having to exchange the mandrel segments. The deviations in the forming surfaces of the mandrel segments from the respective envelope circle will then be irrelevant when the hollow body to be produced is twisted in a respective manner in relation to the forging mandrel.

Especially simple conditions for retooling a forging mandrel to different internal diameters of the hollow body to be produced will be obtained when the mandrel segments are mounted in a radially adjustable manner on the mandrel core via wedge gears. For the purpose of changing the outside diameter of the forging mandrel, it is merely necessary to actuate the wedge gears, which offers the additional possibility of producing hollow bodies with hollow spaces which conically taper in the axial direction, because the diameter of the forging mandrel can be changed continuously in a respective manner during the advancement of the tool.

The mandrel segments which are distributed over the circumference of the mandrel core can also be used for producing hollow bodies with longitudinally grooved hollow spaces. In this case, both the mandrel segments and the circumferential sections of the mandrel core between the mandrel segments form forming surfaces for the hollow space of the hollow body. The precondition for this is however that the forging mandrel is co-rotated with the workpiece. In the case of mandrel segments which are mounted in a continuously adjustable manner in the radial direction on the mandrel core, the grooves in the inside wall of the hollow body which are determined by the mandrel segments can also have a depth which changes over the length of the hollow body.

The subject matter of the invention will be shown by way of example in the drawings, wherein.

Figure 1:
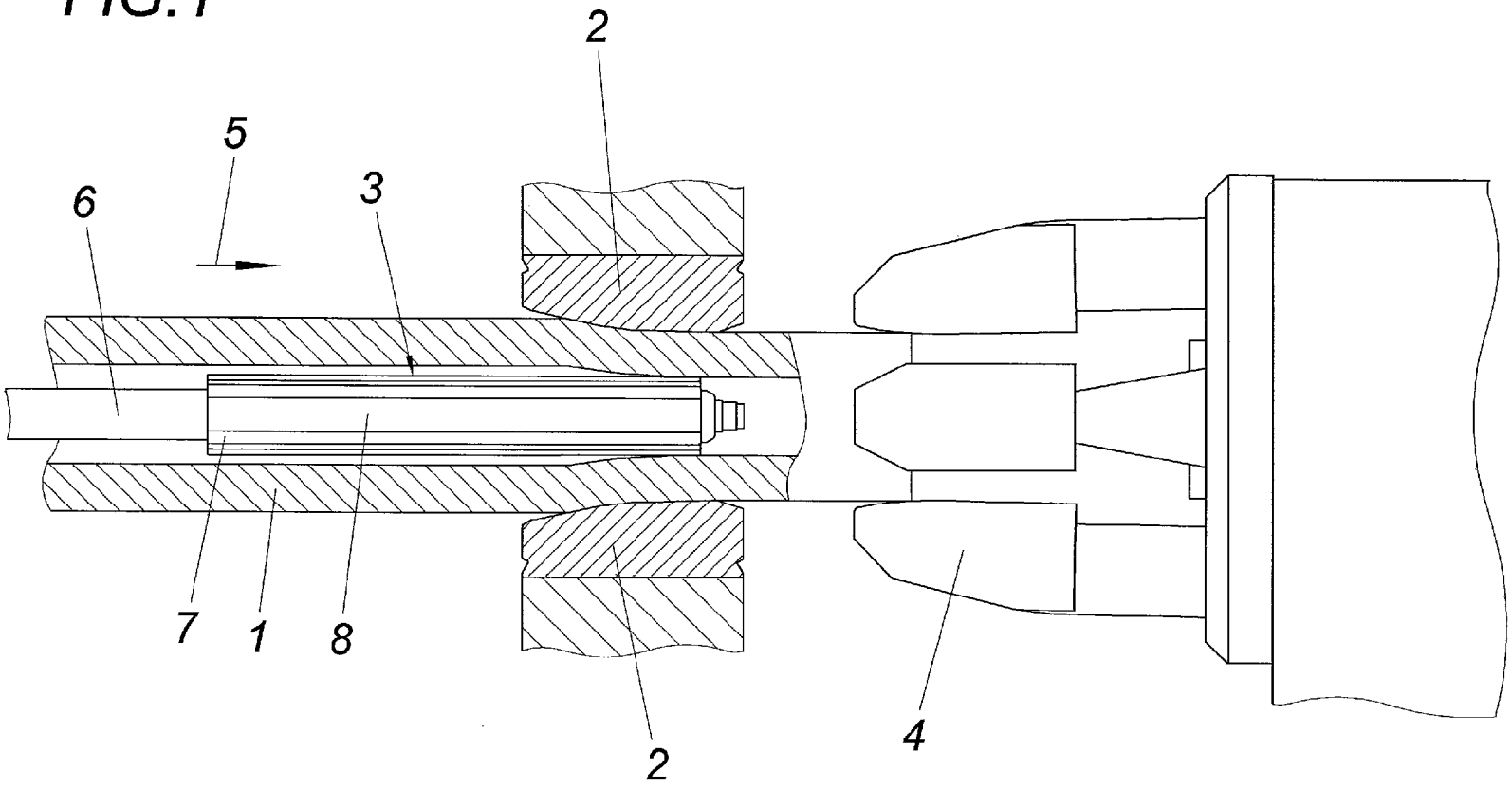
FIG. 1 shows sections of an apparatus in accordance with the invention for forging a hollow body in the region of the forging tools in a schematic longitudinal sectional view.

In accordance with FIG. 1, forging tools 2 which are arranged in a centrically symmetrical way in relation to a forging axis are provided for forging a hollow body 1—which in the case of the embodiment is a tube—, which forging tools 2 cooperate with a forging mandrel 3. The hollow body 1 is conveyed by means of a chucking device 4 in the direction of advancement 5 between the forging tools 2, which forging tools strike the hollow body 1 against the forging mandrel 3. The hollow body 1 can be provided with a rotation about the forging axis if necessary via the chucking device 4. The forging mandrel 3 is conventionally fixed to a mandrel bar 6, via which a lubricant or cooling or heating media can be supplied to the forging mandrel 3 depending on the forging conditions. The forging mandrel 3 can also be driven in a rotating fashion via the mandrel bar 6, if so required by the application.

Figure 2:
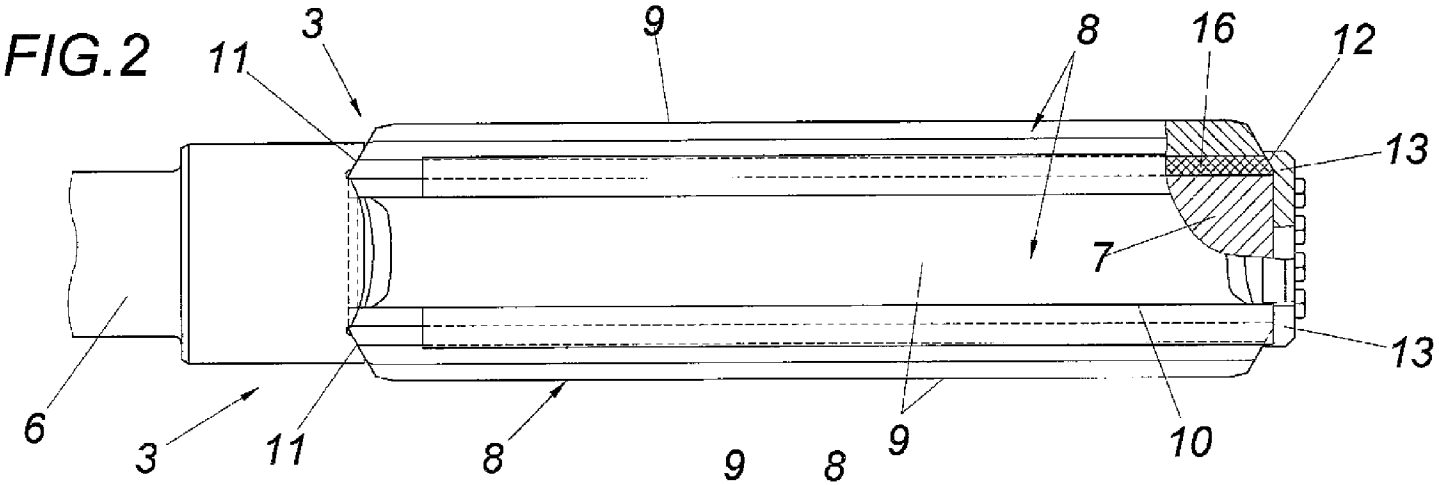
FIG. 2 shows a forging mandrel in a partly elevated, simplified side view.

The forging mandrel 3 differs from conventional forging mandrels because it is composed of a forging core 7 and mandrel segments 8, which are arranged in a distributed manner about the circumference of the mandrel core 7 depending on the circumferential distribution of the mandrel tools 2 and form the forming surfaces 9 for the hollow space of the hollow body 1. As is shown in FIGS. 3 to 7, there are different possibilities for bearing the mandrel segments 8 on the mandrel core 7. In accordance with FIGS. 2 and 3, the mandrel segments 8 are guided in longitudinal grooves 10 of the mandrel core 7 and clamped down on the face side in the radial direction. For this purpose, the mandrel core 7 forms undercuts 11 for accommodating the mandrel segments 8 on the face side, which undercuts cooperate with undercuts 12 of profile strips 13, so that undercut grooves are obtained for accommodating on the face side the mandrel segments 8 between the undercut 11 of the mandrel core 7 and the undercuts 12 of the profile strips 13, which mandrel segments are guided in the longitudinal grooves 10.

Figure 4:
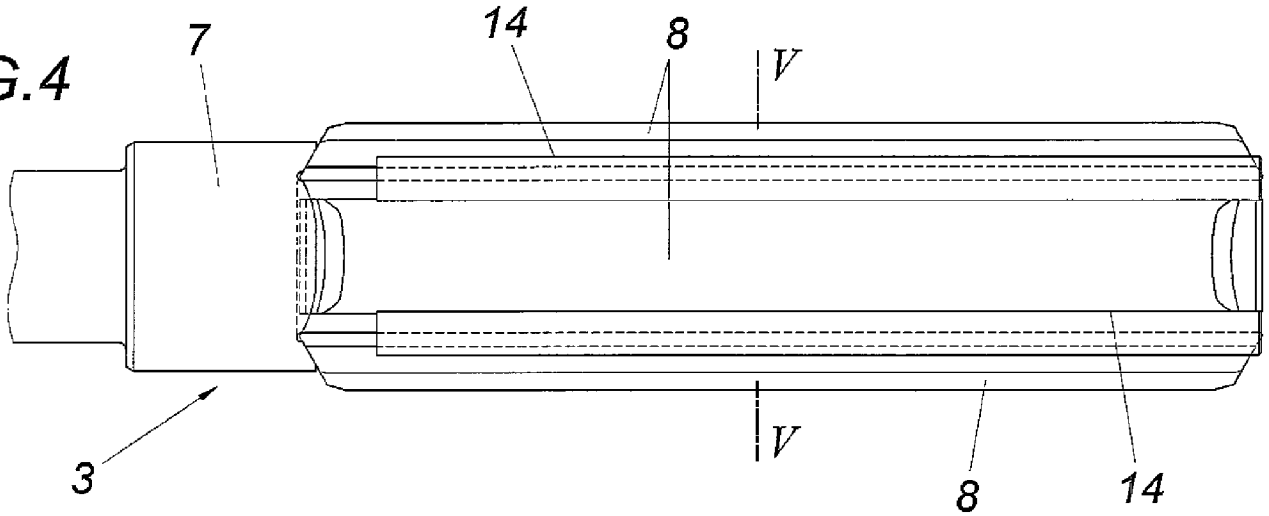
FIG. 4 shows an illustration of an embodiment of a forging mandrel corresponding to FIG. 2.
Figure 5:
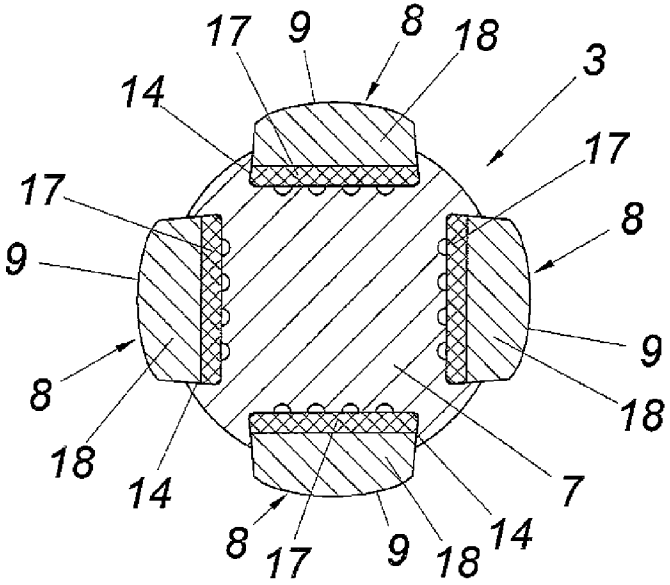
FIG. 5 shows a sectional view along the line V-V in FIG. 4.
Figure 6:
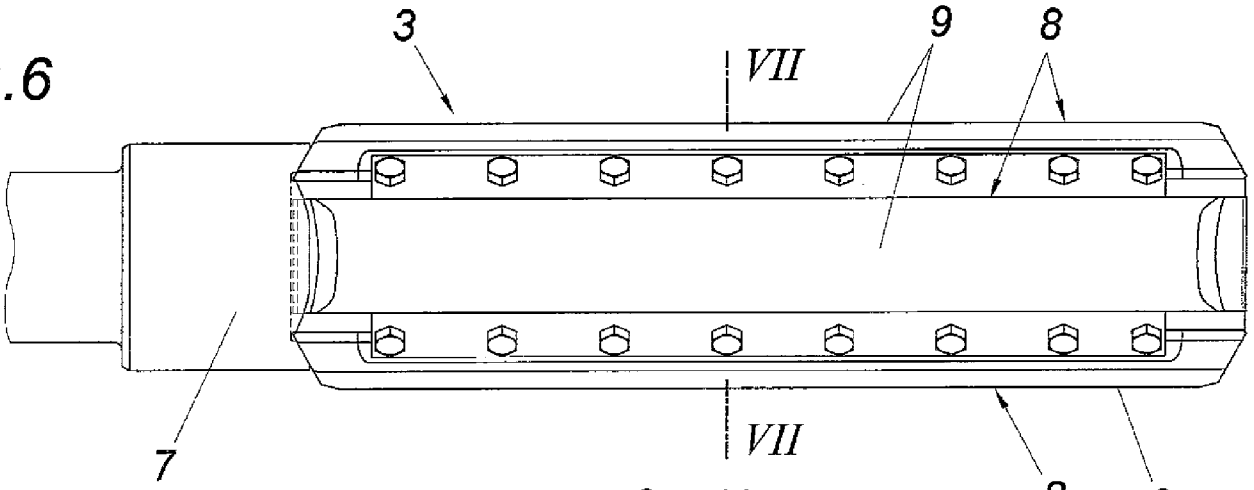
FIG. 6 shows a further embodiment of a forging mandrel in a side view.

In accordance with FIGS. 4 and 5, the mandrel core 7 comprises grooves 14 which are undercut in a dovetail manner for interlocking fixing of the mandrel segments 8. The mandrel segments 8 according to FIGS. 6 and 7 are also held in undercut grooves 14, but said undercut grooves 14 are formed by profile strips 15 forming the groove walls in the embodiment according to FIGS. 6 and 7.

The mandrel segments 8 can be supported via spacers 16 on the mandrel core 7. The envelope circle of the mandrel segments 8 can be adjusted to the respective requirements by said spacers 16. The spacers 16 can also be used for thermal insulation of the mandrel core 7 against the mandrel segments 8.

Figure 3:
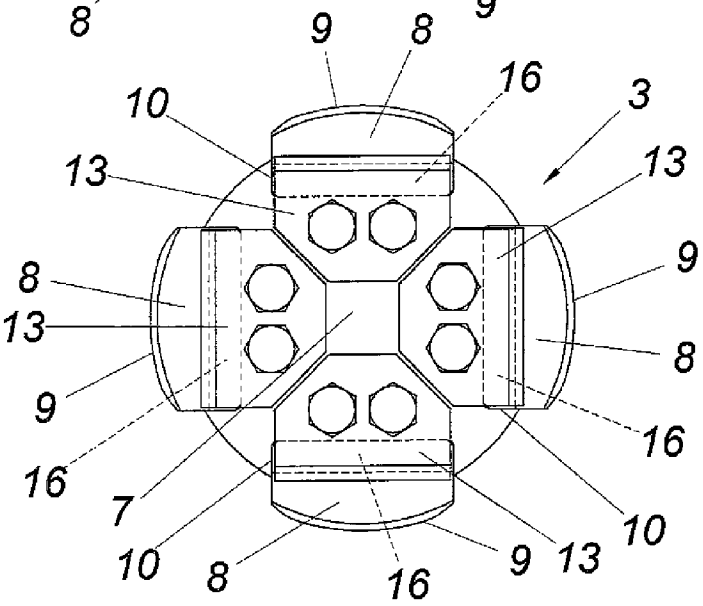
FIG. 3 shows the forging mandrel 2 in a front view on an enlarged scale.

The mandrel segments 8 can be made of different materials. In order to avoid having to produce the entire mandrel segments 8 from a heat-resistant material, the mandrel segments 8 can be made of a supporting base body 17 and a heat-resistant wearing body 18 which forms the forming surfaces 9, as is shown in FIG. 3 and FIG. 4 for example.

Figure 7:
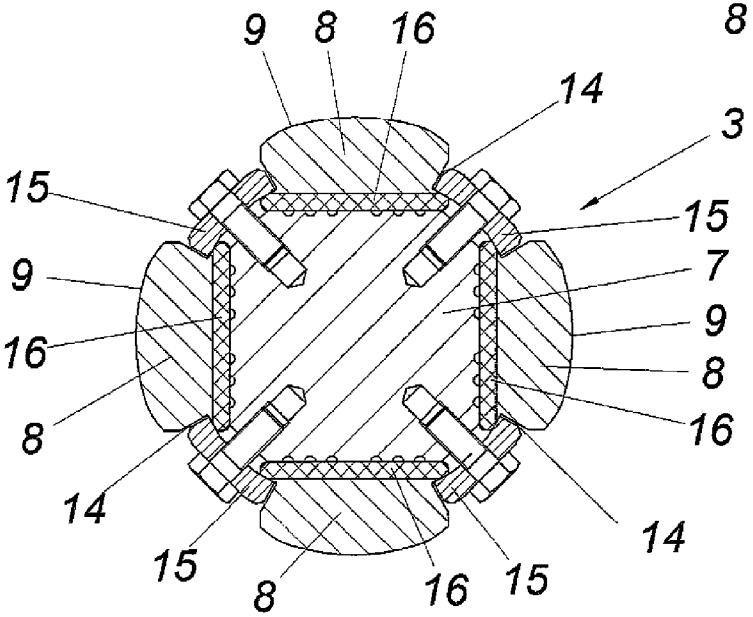
FIG. 7 shows the forging mandrel according to FIG. 6 in a sectional view along the line VII-VII.

FIGS. 5 and 7 show the possibility of cooling or heating the mandrel segments 8, in that channels 19 are arranged in the mandrel core 7 for guiding a cooling or heating medium, which channels are connected via the mandrel bar 6 to a cooling or heating device.

Figure 8:
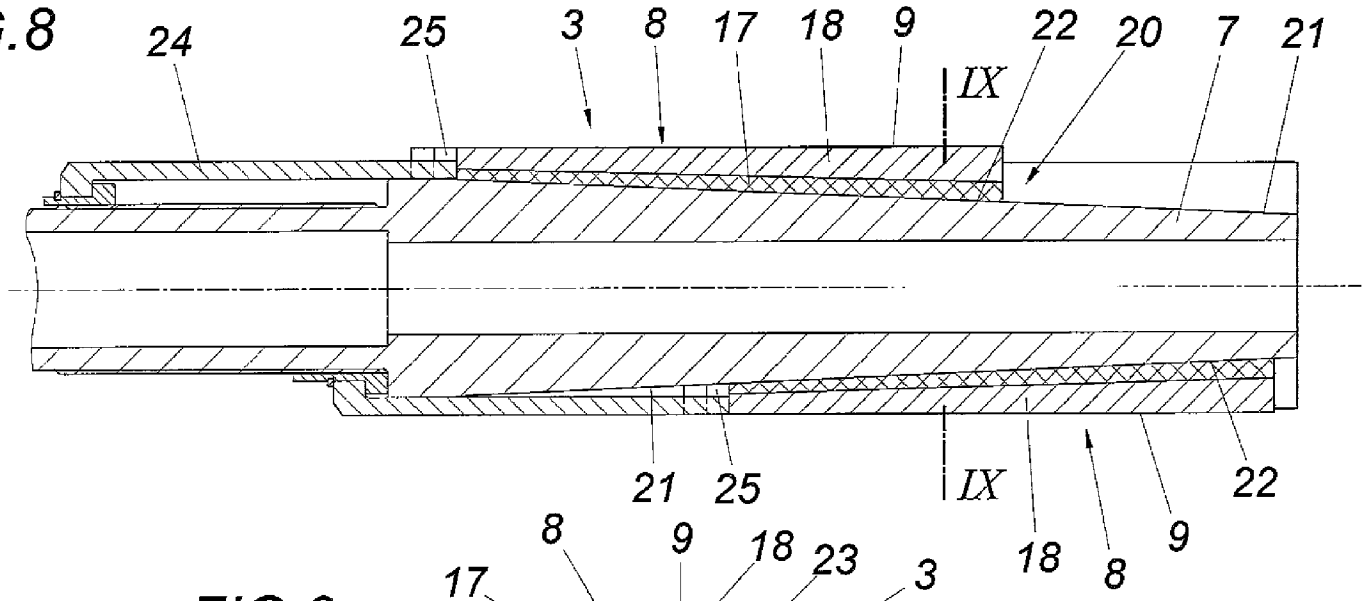
FIG. 8 shows a forging mandrel with radially adjustable mandrel segments in a simplified axial sectional view.
Figure 9:
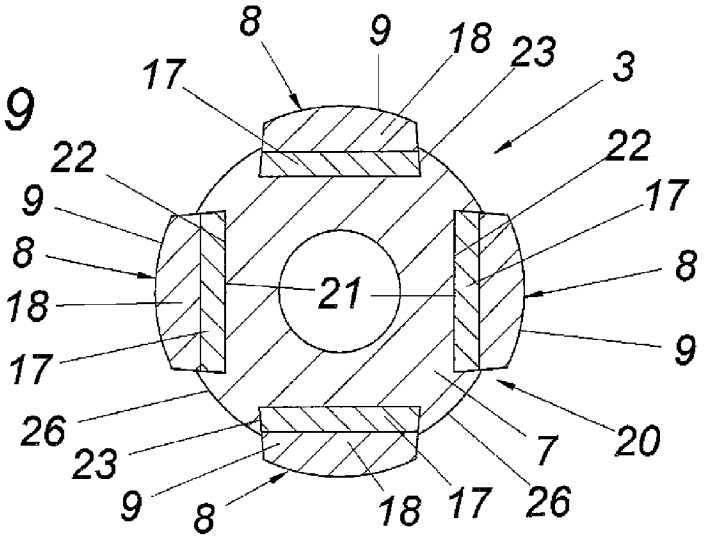
FIG. 9 shows a sectional view along the line IX-IX in FIG. 8 on an enlarged scale.

The embodiment of the forging mandrel 3 in accordance with FIGS. 8 and 9 differs from the other embodiments in such a way that the mandrel segments 8 are held in a radially adjustable manner on the mandrel core 7 which occurs by way of a wedge gear 20. Said wedge gears 20 for the individual mandrel segments 8 comprise wedge surfaces 21 which are associated with the mandrel core 7 and which cooperate with counter-wedge surfaces 22 of the mandrel segments 8 which are guided in a longitudinally displaceable manner in grooves 23 of the mandrel core 7 which are undercut in a dovetail fashion in order to prevent radial lifting of the mandrel segments 8 from the mandrel core 7. The mandrel segments 8 are connected to an adjusting sleeve 24, via which the mandrel segments 8 can be displaced axially in relation to the mandrel core 7, thus leading to a radial displacement of the mandrel segment 8 as a result of the cooperating wedge surfaces 21 and 22. Said radial movement of the mandrel segment 8 in relation to the adjusting sleeve 24 is ensured by a respective guidance of the adjusting sleeve 24 in radially extending undercut grooves 25. FIG. 8 shows the position of the mandrel segments 8 in the radially extended and radially retracted position.

FIG. 9 shows that the circumferential sections 26 of the mandrel core 7 between the mandrel segments 8 can also be used as forming surfaces for forming the inside wall of the hollow body when the forging mandrel follows the rotational movement of the hollow body during the forging process. Hollow bodies 1 with internal grooves can be produced in such a case, which hollow bodies can also have a different depth over their length in the case of a continuous adjustment of the wedge gears.

The invention claimed is:

1. An apparatus for forging a first hollow body having a first hollow space with a first diameter and a second hollow body having a second hollow space with a second diameter different from the first diameter, said apparatus comprising forging tools which are arranged in a centrically symmetrical way about a forging axis, and a forging mandrel, wherein the forging mandrel comprises a mandrel core and first mandrel segments which are distributed over and supported on the circumference of the mandrel core, are exchangeably held on the mandrel core, and form first molding surfaces for the first hollow space of the first hollow body, wherein the first mandrel segments are held on the mandrel core so that the first mandrel segments are replaceable with second mandrel segments forming second molding surfaces for the second hollow space of the second hollow body, and wherein the circumference of the mandrel core is split into circumferential sections.

2. The apparatus according to claim 1, wherein the first mandrel segments are arranged in a thermally insulated manner in relation to the mandrel core.

3. The apparatus according to claim 1, wherein the first mandrel segments are connected to a cooling or heating device.

4. The apparatus according to claim 1, wherein the first mandrel segments are inserted in an interlocking manner into undercut grooves.

5. The apparatus according to claim 4, wherein at least one side wall of the undercut grooves is arranged as a profile strip which is detachably connected with the mandrel core.

6. The apparatus according to claim 1, wherein the first mandrel segments are supported on the mandrel core via spacers.

7. The apparatus according to claim 1, wherein the first mandrel segments are mounted in a radially adjustable manner on the mandrel core via wedge gears.

8. The apparatus according to claim 1, wherein both the first mandrel segments and the circumferential sections of the mandrel core form molding surfaces for the first hollow space of the first hollow body between the first mandrel segments.

* * * * *